United States Patent [19]

Shank

[11] Patent Number: 4,765,116

[45] Date of Patent: Aug. 23, 1988

[54] BRICK MASON'S SPACER AND METHOD OF USING THE SPACER

[76] Inventor: Donald H. Shank, 20273 Delise Dr., Hemet, Calif. 92343

[21] Appl. No.: 61,272

[22] Filed: Jun. 12, 1987

[51] Int. Cl.[4] ..... G01B 3/22; E04B 1/02

[52] U.S. Cl. ..... 52/747; 33/168 R; 33/518

[58] Field of Search ..... 2/163, 161 A, 21; 15/105.5; 33/518, 168; 52/747; 223/101; 294/25; 131/247

[56] References Cited

U.S. PATENT DOCUMENTS

| | | | |
|---|---|---|---|
| 718,652 | 1/1903 | McMillan | 2/21 |
| 849,182 | 4/1907 | Adkins | 294/25 |
| 1,184,710 | 5/1916 | Baumann | 2/21 |
| 1,380,960 | 6/1921 | Hmenia | 223/101 |
| 3,290,712 | 12/1966 | Richey | 33/518 |
| 3,484,943 | 12/1969 | Yarbrough | 33/518 |
| 4,084,824 | 4/1978 | Kalivas | 294/25 |
| 4,102,093 | 7/1978 | Harris | 294/25 |
| 4,408,398 | 10/1983 | Glaze | 33/518 |

FOREIGN PATENT DOCUMENTS

| | | | |
|---|---|---|---|
| 474150 | 10/1927 | Fed. Rep. of Germany | 2/21 |
| 814718 | 9/1951 | Fed. Rep. of Germany | 2/21 |

*Primary Examiner*—John E. Murtagh

*Attorney, Agent, or Firm*—Edward J. Quirk

[57] ABSTRACT

A tool for use with building block or brick walls consisting of a flexible rubber cavity worn over the index finger of one hand and containing an integral rectangular end with front and rear flat parallel sides. The rectangular end extends downwardly at 90° from the axis of the finger and is placed over the side of a brick when grasped by the hand. The shape of the finger cavity approximates the shape of the finger and contains an irregular lip and depression to maintain a secure fit even when the finger is bent and moved. A method of using the tool involves laying building blocks with adhesive between the blocks.

5 Claims, 1 Drawing Sheet

BRICK MASON'S SPACER AND METHOD OF USING THE SPACER

BACKGROUND OF THE INVENTION

This invention relates to a tool for evenly spacing units of bricks or other construction materials from adjacent units. More specifically, this invention relates to a flexible sheath or sleeve that is worn over the index finger of one hand and that contains an integral solid block molded onto the end of the finger cavity which is inserted between two bricks for correctly positioning them apart.

The building of walls with block and mortar is a demanding labor requiring great skill and experience. The brick mason continually strives to place each brick the same height above the row below and to space each brick the same distance apart from the adjacent one. Usually, a spacer of the desired thickness is used to accomplish the repetitive placing of adjacent brick.

Time is of the essence and the faster the brick mason can work the more financially rewarding his endeavors will be. However, speed must never be sacrificed for accuracy and various means have been employed in the past to properly and quickly position the bricks. The brick mason almost always employs a spacer to be inserted between two bricks to obtain the proper spacing. While one hand holds a trowel and is used to apply mortar to the wall, the other hand grasps the brick and positions it in the proper location. As a result, no "third hand" is available to work or use the spacer unless the trowel is put down. It is obviously desirable, therefore, to have both hands "free" to continually and repetitiously apply mortar with one hand and place the bricks with the other hand.

The present invention provides a method of spacing bricks while at the same time allowing both hands to be "free". The invention is a tool that consists of a flexible rubber sleeve which slides over the index finger of a mason's hand and is frictionally retained in place. A solid block spacing member is integrally molded to the end of the sleeve and extends downwardly at 90° to the axis of the finger. The block or spacer has flat, substantially parallel front and rear surfaces that abut the parallel facing end of two adjacent bricks and separate them by the thickness of the block. Since the tool is worn on the mason's finger, the block-placing hand now performs two functions smoothly and efficiently at the same time.

Most experienced masons either visually spaced adjacent bricks, thus estimating the proper distance between the bricks without the assistance of a spacing tool, or use their index finger to perform the spacing function by grasping the brick in their left hand such that the last knuckle of the finger extends over the end of the brick and can be used to "feel" the adjacent brick. Use of an index finger to provide brick spacing exposes the mason's skin to caustic mortar and to potential injury. Recognizing these risks, spacing tools have also been used; for example, a spacing device has been incorporated into the end of a trowel as disclosed in the Rickey patent, U.S. Pat. No. 3,290,712. This design, however, requires that the trowel be cleared of any mortar and then turned on end to insert the spacer between the blocks.

The present invention is a distinct departure and improvement over the prior art. A mason's left hand, which for a right-handed person is used to position the next brick to be laid, can now be utilized to perform two functions instead of only one, and the right hand is free at all times to manipulate the trowel. A brick can be placed and spaced in a single motion, and the trowel hand can scrape away or apply mortar as needed. The brick mason can operate more quickly and effectively and with greater precision.

Accordingly, it is an object of the present invention to provide a method and apparatus for enabling a brick mason to quickly and accurately lay adjacent bricks with a precise desired spacing. It is a further object of the invention to provide a bricklayer's spacing tool which is simple and easy to manufacture, and which is automatically adaptable to fit a user's index finger regardless of size. It is still a further object of the invention to provide a sheath or sleeve mountable on a mason's index finger which provides an integral spacing tool and also protects the mason's finger from damage or injury. These and other objects are provided by the spacing tool of the invention, a preferred embodiment of which is subsequently described herein.

SUMMARY OF THE INVENTION

A finger-mounted tool to enable a brick mason to evenly space adjacent bricks comprises an elongate flexible finger cot or sheath having a finger receiving cavity and an integral spacing member or block integrally molded onto the end of the sheath. The block extends downwardly at 90° from the axis of the finger cavity and has flat, substantially parallel front and rear walls. An irregular lip and constriction are formed into the sheath to prevent entry of debris and to provide a secure fit.

DETAILED DESCRIPTION OF A PREFERRED EMBODIMENT

Figure 2:
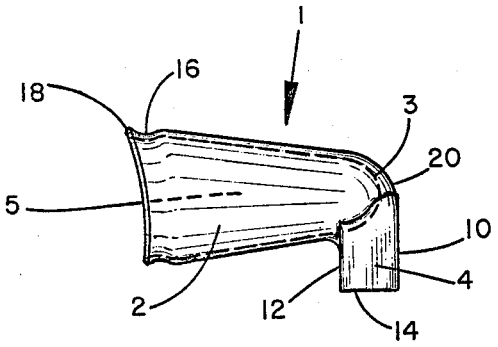
FIG. 2 is a side elevation view of the spacing tool.

Referring first to FIG. 2, the spacing tool of the invention comprises a one-piece flexible molded unit having a hollow sheath or sleeve portion 2 and a solid spacing member 4 mounted perpendicularly to and depending downwardly from the sheath. The sheath portion consists of a cot having a relatively thin membrane or wall of substantially circular cross-section; the diameter of the cross-section is about 1" at the opening and decreases slightly toward the forward or enclosed end 3 of the sheath to provide satisfactory frictional engagement with the index finger of a user's hand, thereby assuring a slip-free fit. The walls of the sheath are sufficiently flexible to expand to accommodate fingers of various sizes such that a single size will fit all users. The wall of the sheath defines an internal finger-receiving cavity or chamber 5 (as seen by the phantom lines in FIGS. 2 and 3) which provides a mounting means for the sheath on the user's hand. If desired, the cross-section of the sleeve can be slightly oval in shape rather than circular.

Figure 4:
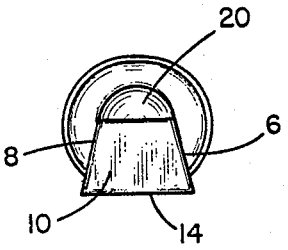
FIG. 4 is a front elevation view of the spacing tool.

Front and rear surfaces 10 and 12, respectively, of spacing member 4 are flat and substantially parallel and are oriented to the axis of sheath 2 at about 90°. Opposing sides 6 and 8 of the spacing member are flat and form an acute angle of approximately 30° as shown in FIG. 4. Bottom surface 14 is flat, rectangular in shape and parallel to the axis of sheath 2. Accordingly, the lower portion of the spacing member has the shape of a truncated pyramid. The thickness of the spacing member (i.e., the distance between the front and rear surfaces 10 and 12) is very important since it determines the spacing distance between adjacent units. The thickness is generally from about ¼" to about ½", and for conventional bricks is about ⅜".

Figure 1:
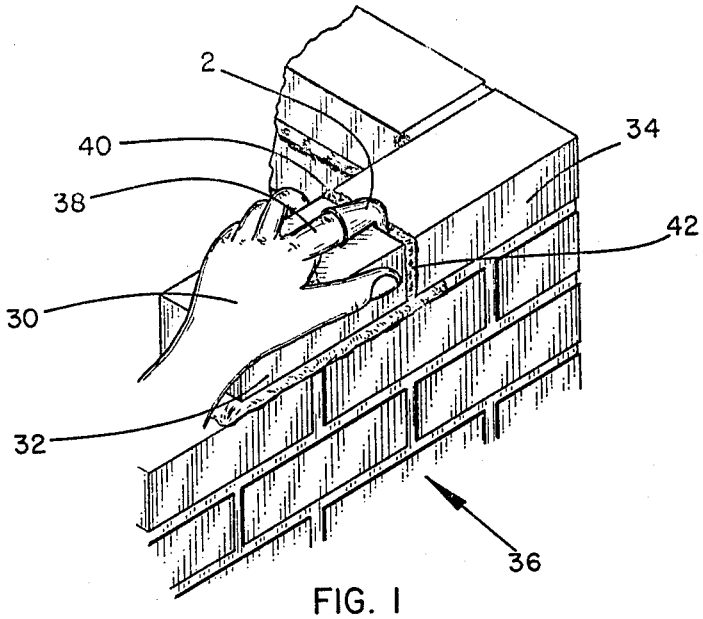
FIG. 1 is a perspective view of the brick masons' spacing tool in use in forming a brick wall.
Figure 3:
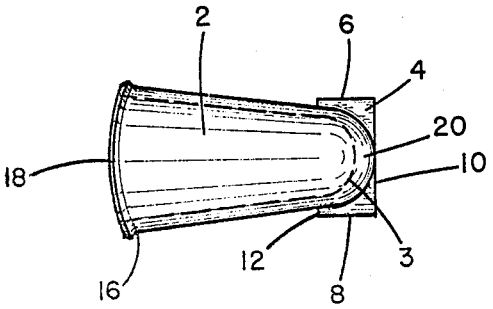
FIG. 3 is a plan view of the spacing tool.

Sleeve portion 2, shown in FIG. 1, approximates the shape of the end of an index finger and has a hollow cavity having an opening at one end. The phantom line of FIG. 2 shows the shape of finger cavity 5 as defined by the sleeve from a side view and the phantom lines of FIG. 3 show the shape of the finger cavity from a top view. The wall thickness of sheath 2 is generally less than about 0.1", and is freferably from 0.01–0.05", still more preferably approximately 0.020" to provide stretchability to ensure a secure and comfortable fit. The length of the finger cavity 5 is approximately 1¼"; when in place on the index finger, the sleeve 2 extends rearwardly to about midway between the first and second knuckle of the user's hand. As shown in FIG. 2 and FIG. 3, a slight indentation or constriction 16 is formed near the open end of sleeve 2 to assist in gripping the finger. In addition, lip or flange 18 is formed to provide structural stability to the end of the sleeve portion. Constriction 16 and a slightly irregular shape of lip 18 combine to keep sleeve 2 in continuous contact with the finger as a user moves and bends his finger during the working day. The arcs and bends of lip 18 allow compound bending of the flexible rubber material without gaps forming between the finger and finger cavity. Unwanted dirt and debris are excluded and the spacing tool remains intact without slipping off.

The overall length of the brick mason's spacer from lip 18 to front side 10 is approximately 1–¾" and the overall height is approximately 1". Nose surface 20 is smooth and gently curved at a radius of ⅜" in the vertical position shown in FIG. 1 and at a radius of 5/16" in the horizontal position shown in FIG. 3. The spacing tool is preferably molded in a single mold from a durable rubbery material such as actual rubber or a synthetic elastomer.

Use of the spacing device of the invention is best shown in FIG. 1. A brick mason's hand 30 is shown laying a brick 32 in a row adjacent to a second brick 34 in a wall 36. The mason is wearing a spacing tool on the index finger 38 of his left hand. In laying the brick, the mason picks up the brick in his left hand (if he is right-handed), hooking the spacing member portion of the tool 4 over the end of the brick as shown in the drawing. He then picks up mortar with a trowel in his right hand (not shown) and scrapes mortar or other adhesive on the end face of the brick as shown at 40 and 42, and also places mortar on the bottom of the brick. He then places the brick on the row as shown in FIG. 1, moving the brick in aligned relationship to adjacent brick 34 until the spacing member touches both bricks. He then removes his hand, and the brick has been properly placed. If the bricks are being laid on a flat surface such as a walk or patio, the mortar may later be filled into the space left by the spacing tool. The invention may of course be used to space any two adjacent items and is not limited to bricks or other block-type construction materials.

The invention has been described with respect to a preferred embodiment, and various modifications and adaptations may be made within the spirit and scope of the invention. Accordingly, the invention should not be limited by the foregoing description, but rather should be defined only by the following claims.

I claim:

1. A one-piece molded spacing device for enabling uniform spacing of adjacent construction blocks comprising a sheath portion and a spacing member portion, the sheath portion comprising a finger-receiving sleeve having an opening at an end thereof for insertion of a user's index finger, said sleeve being formed from a flexible and stretchable material having a wall thickness of less than 0.1", and a second end portion of the sleeve being enclosed, said spacing member portion extending approximately perpendicularly from an axis of the sleeve and having parallel front and rear wall surfaces having a spacing therebetween of from about ¼"–½" substantially equal to the desired spacing between adjacent construction blocks.

2. The spacing device of claim 1 wherein the spacing member portion has the shape of a truncated pyramid having two substantially parallel front and rear walls, a flat bottom wall, and radially divergent side walls.

3. A method of laying a plurality of units of building materials with uniform spacing between adjacent units comprising placing a spacing device on an index finger of a hand of a user, grasping a first unit of building material with the hand in such a manner that the spacing device extends adjacent to a peripheral surface of the first unit, placing adhesive on said surface of the first unit, positioning the first unit adjacent to a second unit such that the spacing device contacts both the first and second units, and removing the spacing device from between the units.

4. The method of claim 3 wherein the spacing device is a one-piece moulded unit comprising mounting means for removably attaching the device to user's finger, and a spacing member extending from the mounting means having a thickness substantially equal to the desired distance between adjacent units.

5. The method of claim 3 wherein the spacing device comprises a sheath portion and a spacing member portion, the sheath portion comprising a finger-receiving sleeve having an opening at an end thereof for insertion of a user's finger, said sleeve being formed from a flexible and stretchable material having a wall thickness of less than 0.1", and a second end portion of the sleeve being enclosed, said spacing member portion extending angularly from an axis of the sleeve and having parallel front and rear wall surfaces having a spacing therebetween substantially equal to the desired spacing between adjacent construction blocks.

* * * * *